United States Patent [19]

Altemark et al.

[11] Patent Number: 5,055,032

[45] Date of Patent: Oct. 8, 1991

[54] A BURNER WITH A FLAME RETENTION DEVICE

[75] Inventors: Detlef Altemark, Dorsten; Gerhard Stenzel, Meerbusch; Manfred Weid, Haltern, all of Fed. Rep. of Germany

[73] Assignee: Ruhrgas Aktiengesellschaft, Essen, Fed. Rep. of Germany

[21] Appl. No.: 420,563

[22] Filed: Oct. 12, 1989

[30] Foreign Application Priority Data

Oct. 12, 1988 [DE] Fed. Rep. of Germany ..... 3834762
Oct. 18, 1988 [DE] Fed. Rep. of Germany ..... 3835381

[51] Int. Cl.[5] ..... F23R 3/06

[52] U.S. Cl. ..... 431/158; 431/154; 431/352; 431/353; 431/264; 60/753

[58] Field of Search ..... 431/8, 10, 160, 158, 431/154, 349, 351, 352, 353, 181, 264; 60/751, 752, 753, 39.821

[56] References Cited

U.S. PATENT DOCUMENTS

| | | | |
|---|---|---|---|
| 2,417,835 | 3/1947 | Moore | 431/158 X |
| 2,485,207 | 10/1949 | Logan | 431/352 |
| 2,499,207 | 2/1950 | Wolfersperger | 431/158 X |
| 2,720,080 | 10/1955 | Oulianoff et al. | 60/752 X |
| 3,186,168 | 6/1965 | Ormerod et al. | 60/752 X |
| 3,574,508 | 4/1971 | Rothhaar | 431/351 |
| 3,730,668 | 5/1973 | Iida et al. | 431/158 X |
| 3,738,792 | 6/1973 | Fenig | 431/158 |
| 4,008,568 | 2/1977 | Speans, Jr. et al. | 431/353 X |
| 4,012,189 | 3/1977 | Vogt et al. | 431/158 |
| 4,586,894 | 5/1986 | Wunning | 431/160 X |
| 4,726,763 | 2/1988 | Newman | 431/353 X |

FOREIGN PATENT DOCUMENTS

| | | | |
|---|---|---|---|
| 3702359 | 8/1987 | Fed. Rep. of Germany | 431/8 |
| 1033539 | 7/1953 | France | 431/352 |
| 669751 | 4/1952 | United Kingdom | 60/752 |

*Primary Examiner*—Carl D. Price
*Attorney, Agent, or Firm*—Blakely, Sokoloff, Taylor & Zafman

[57] ABSTRACT

The burner comprises a combustion chamber equipped with a flame retention cone. The flame retention cone comprises a diverging jacket with orifices for the passage of oxygen-carrier gas. A fuel lance provided with radially arranged exit openings has its outlet in an upstream inlet section of the flame retention cone. An igniter is arranged in an oxygen-carrier gas duct outside an ignition opening provided in the area of the fuel lance exit openings. The combustion chamber is accommodated inside an outer tube. The downstream ends of the combustion chamber and the outer tube enclose openings spaced, relative to each other, in the circumferential direction to allow the exit of oxygen-carrier gas. The burner provides for flame stability and low-polluting combustion.

29 Claims, 8 Drawing Sheets

A BURNER WITH A FLAME RETENTION DEVICE

BACKGROUND OF THE INVENTION

1. Field of the Invention

The present invention relates to the field of combustion engineering and, more specifically, to a low-polluting burner or high-velocity burner with high flame stability.

2. Prior Art

A paper published in 1987 on page 352 of the West German VDI-Bericht No. 645 discloses a high-velocity burner with a combustion chamber arranged inside an outer tube mounted on a body to obtain a configuration in which said outer tube is a continuation of an oxygen-carrier gas duct enclosed by said body. The combustion chamber end facing said body is provided with a flame retention device which is a flat burner plate. Said burner plate is provided with orifices allowing the passage of part of said oxygen carrier gas and with a central fuel inlet. The other part of said oxygen carrier gas enters the annular space between said combustion chamber and said outer tube and passes through radial openings in said combustion chamber into the space inside said combustion chamber upstream from the downstream end thereof.

SUMMARY OF THE INVENTION

It is the main object of the present invention to provide for a burner with improved combustion behavior.

It is more specifically an object of the present invention to provide for a burner with improved flame stability.

It is further more specifically an object of the present invention to provide for a burner designed for a reduced output of pollutants such as, more particularly, oxides of nitrogen.

The present invention proposes a burner with a body containing a duct through which an oxygen-carrier gas passes. Said duct continues through an outlet tube provided with an open upstream end fixed to said body and an open downstream end. A combustion chamber having an open upstream end and an open downstream end is mounted in said outer tube so that the downstream end of said combustion chamber is substantially in alignment with the downstream end of said outer tube, said combustion chamber and outer tube downstream ends enclosing exit openings spaced relative to each other in the circumferential direction allowing the exit of a secondary part of said oxygen-carrier gas through said openings. A flame retention device is mounted in the upstream part of said combustion chamber. Said flame retention device has a substantially conical jacket diverging from a central inlet towards said combustion chamber. Said jacket is provided with orifices for the passage of a primary part of said oxygen-carrier gas. Said burner further comprises means to take a fuel to the inlet of said flame retention device.

Due to the improved flame stability provided for by a burner of such a design, the rangeability of such a burner is twice that of a conventional burner and is at least 1:40 even for very large burners rated in excess of 350 KW. The burner proposed herein is fit for ambient temperatures which may be as high as 1,600° C. or higher.

Low noise emission is a particular advantage of the burner proposed by the invention divulged herein.

The present invention exploits the insight that blending of a secondary part of an oxygen-carrier gas such as secondary air with a primary oxygen-carrier gas/fuel mixture upstream from the discharge port of a combustion chamber accelerates mixing, thereby producing a very high flame temperature favoring the formation of oxides of nitrogen.

Unlike conventional burners, the burner proposed by the present invention thereby provides for the secondary part of the oxygen-carrier gas supplied for staged combustion to be discharged from the burner in a jet-type fashion with the jets substantially merely reaching the outer part of a flame discharged from said combustion chamber. The invention therefore allows an excellent control of the mixing of the oxygen-carrier gas with the flame and hence combustion in the second combustion stage. The more said oxygen-carrier gas is mixed with said flame, the shorter, the more well-defined and the richer in oxides of nitrogen the flame and the less said oxygen-carrier gas is mixed with said flame, the longer, the softer and the poorer in oxides of nitrogen the flame. The teachings of the present invention therefore allow an optimization of flame length and the emission of oxides of nitrogen.

Flow through the flame retention device may be improved by providing for a configuration in which the centerlines through the orifices in said flame retention device being at right angles relative to the tangents of the jacket of said flame retention device in the direction of fluid flow through said flame retention device and said centerlines and the tangents to said jacket in the direction of the circumference of said jacket enclosing an angle of between 90° and 45°. If said latter angle is 90° then said flame retention device may also be fabricated at very low cost. As said angle is increased beyond 90° the swirl of the fluid entering the coal-shaped flame retention device accelerates.

As described above, the high-velocity burner proposed by the present invention is a staged combustion burner in which oxygen-carrier gas supply is staged. As the flame retention device into which pure fuel is injected is cone-shaped and the orifices provided in said flame retention device for the passage of the oxygen-carrier gas into the space inside said flame retention device are distributed over the surface of the jacket of said flame retention device, the first combustion stage is staged in itself thereby reducing the formation of pollutants and, in particular, the formation of oxides of nitrogen. The combustion air supplied to the proposed burner may be preheated to a temperature in excess of 600° C. without substantially affecting the low-polluting combustion characteristics. A recuperator may be provided for combustion air preheating. Further, since high flame stability is characteristic of the burner divulged herein, the air ratio of the first stage of the combustion on the flame retention cone may be kept extremely low allowing a substantial part of the combustion to take place in the second stage where the flame temperature is relatively low.

Since the high-velocity burner divulged by the present invention may be operated at a very low heat input, the combustible mixture may be ignited directly without using a pilot burner. In a preferred embodiment of the present invention, the flame retention device is therefore provided with an ignition opening in the area of the exit openings of the fuel lance and an ignition device is arranged inside the oxygen-carrier gas duct outside said ignition opening. During ignition, the spark or the arch generated by the igniter is carried by the oxygen-carrier gas through the ignition opening to ignite the fuel discharged through the substantially radial exit openings of the fuel lance. In the arrangement described, the igniter is always at a relatively low temperature in the oxygen-carrier gas duct outside the flame retention device where it is immersed in the stream of oxygen-carrier gas which is normally air which also cools the wall of said flame retention device.

If the fuel lance exit openings are in the area of the flame retention device orifices, one of said orifices may serve as the ignition opening. In such an embodiment of the present invention, the fuel lance exit openings are preferably situated opposite to corresponding flame retention device orifices to optimize the mixing of the fuel and the oxygen-carrier gas. Said corresponding flame retention device orifices would, in most cases, be the bottom orifices in said flame retention devices. However, such a configuration may be the cause of vibrations. To control vibrations, it may be advantageous if the exit openings in said fuel lance are arranged upstream from the flame retention device openings even though a separate ignition opening may be necessary.

The jointing of the ceramic outer tube and the burner body may be held to be difficult. According to the teachings of the present invention, said outer tube is held on a ring mounted on said burner body, the joint being tensioned, but elastic. The tension is preset at an optimum value and the assembly comprising the combustion chamber and the secondary air ducting may then be attached to or detached from the burner body by fastening or unfastening the ring attachment to said body.

In a preferred embodiment of the present invention, the openings from which the secondary part of the oxygen-carrier gas exit consits of concave cavities in the downstream end of the combustion chamber and/or convex cavities in the outer tube. If said openings are provided by concave cavities in the combustion chamber, the flame exiting therefrom is grooved and the secondary oxygen-carrier gas jets exiting from the openings run inside the "grooves" so formed in the flame. If the outer tube or the jacket are provided with convex cavities, then the secondary oxygen-carrier gas jets exiting from the openings adjoin the outer flame periphery. If concave cavities are provided in the combustion chamber and convex cavities in the outer tube and if two corresponding cavities adjoin each other, then the secondary oxygen-carrier gas jets issuing from such openings are partially embedded in the flame, but if two corresponding cavities do not adjoin each other, but are displaced relative to each other, then part of said oxygen-carrier gas jets are embedded in the flame and part of said jets adjoin the outer flame periphery, the pattern being undulated in the circumferential direction. The present invention thence provides for a multiplicity of combinations allowing the control of secondary oxygen-carrier gas and flame mixing and flame cooling, each such combination producing a different effect on flue gas recirculation which also affects the emission of oxides of nitrogen from the burner, as the oxygen-carrier gas pattern controls flame, oxygen-carrier gas and flue gas layering.

The cross-sectional area of the combustion chamber may remain unchanged over the entire combustion chamber length. The present invention is particularly advantageous, though, if the downstream end of the combustion chamber is a nozzle, as the entry of oxygen-carrier gas upstream from the throat of such a nozzle would otherwise tend to cause oxides of nitrogen formation to peak.

According to the teachings of the present invention, the openings from which the secondary part of the oxygen-carrier gas exits may be convergent, allowing the secondary oxygen-carrier gas jets to penetrate the flame as desired to control secondary oxygen carrier gas/flame mixing.

The present invention may be applied with particular advantage, if the proposed burner is fabricated from castable material such as ceramic material, as the combustion chamber and the outer tube may be separate burner elements. If they are such separate elements, then it is particularly advantageous to fabricate a burner wherein the combustion chamber is displacably arranged in the outer tube to avoid the build-up of thermal stress.

Depending on the manufacturing technique eventually chosen, the wall thicknesses of the combustion chamber and the outer tube are preferably the same to avoid thermal stress.

BRIEF DESCRIPTION OF THE DRAWINGS

Further details, characteristics and advantages of the present invention are divulged in a description of preferred embodiments referring to the accompanying drawings in which.

DETAILED DESCRIPTION OF PREFERRED EMBODIMENTS

The high-velocity burner divulged herein is a two-stage burner which will now be described in more detail by reference to the accompanying drawings showing preferred embodiments of the present invention.

Figure 1:
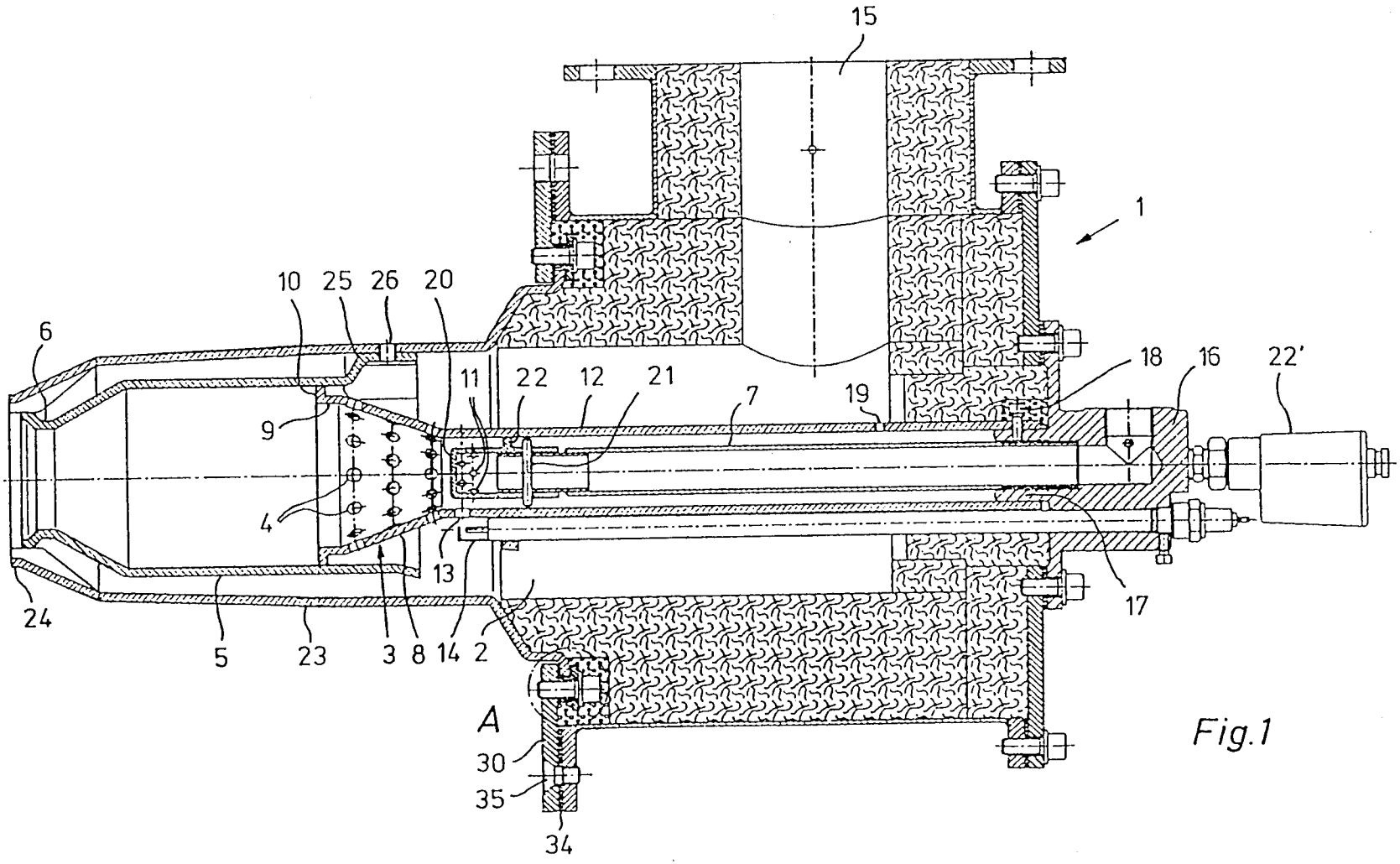
FIG. 1 is a schematic longitudinal section of a high-velocity burner according to the present invention.

As depicted in FIG. 1, said burner comprises a body 1 providing a duct 2 to carry an oxygen-carrier gas which may be air as in the case of the embodiment of the present invention shown by FIG. 1. A flame retention device 3 provided with orifices 4 is arranged inside said duct 2. Said flame retention device 3 is adjoined by a combustion chamber 5 having a nozzle 6 at its downstream end. A fuel lance 7 is provided to take fuel to said flame retention device 3. Said fuel may be gas as in the case of the embodiment of the present invention shown in FIG. 1.

According to the teachings of the present invention, orifices 4 are arranged in a jacket 8 of flame retention device 3 expanding in the direction of flow. The characteristics hereinbefore described provide for very favorable combustion allowing a rangeability of 1:40 even in the case of very powerful burners and keeping noise and pollutant emissions very low.

Jacket 8 of flame retention device 3 extends into a cylindrical section 9 provided with a radial flange 10 adjoining combustion chamber 5. The transition between said cylindrical section 9 and said radial flange 10 produces an additional flame retention effect contributing to flame stabilization.

As depicted in FIG. 1, the orifices 4 in the flame retention device 3 are arranged on adjacent lines around the circumference of jacket 8, and displaced relative to each other. The center-lines lines through each such orifice 4 and the surface of said jacket 8 encloses a right angle favoring flow through flame retention device 3. The fuel lance 7 is provided with radial exit openings 11 in communication with the space inside the cylindrical section 12 of flame retention device 3 upstream from orifices 4 in jacket 8 downstream from said cylindrical section 12, allowing the gas to enter the flame retention device 3 in an advantageous manner. An ignition opening 13 is arranged in cylindrical section 12 in the area of the radial exit openings 11. An igniter 14 which may be a spark igniter as in the case of the embodiment of the present invention depicted in FIG. 1 is arranged in duct 2 outside ignition opening 13. Said spark igniter 14 is in a relatively cold part of the burner divulged by the present invention as it is permanently cooled by air like the wall of flame retention device 3. Upon ignition, the spark or an arc is carried by air through ignition opening 13 to cause the ignition of the gas/air mixture. The spark igniter is rotatable to allow an adjustment of the spark gap between igniter 14 and ignition opening 13.

Upstream from flame retention device 3, duct 2 is connected with an airline 15, air flowing to the burner for combustion being deflected to develop a substantially regular flow pattern co-axial with flame retention device 3 upstream from said device 3.

Body 1 comprises a base block 16 carrying a stub 17 at the end facing fuel lance 7. Said fuel lance 7 is screw-connected with said stub 17. Further, the cylindrical section 12 upstream from jacket 8 is mounted on said stub 17. A screw 18 secures both flame retention device 3 and fuel lance 7 to base block 16 to provide for a favorable design.

A purge opening 19 is provided in the cylindrical section 12 of flame retention device 3 to allow a continuous airflow from duct 2 to the jacket 8 of flame retention device 3 preventing the backflow of gas.

Fuel lance 7 is fitted with a tip 20 wherein the exit openings are arranged, said tip 20 being secured by bolt 21. If the flame retention device 3 is pulled off fuel lance 7, bolt 21 is released.

Fuel lance 7 is provided with elements 22 to provide support on the cylindrical section 12 of flame retention device 3. Said fuel lance 7 is turned so as to provide an ultraviolet flame detection device 22' an unrestricted view of combustion chamber 3.

Flame retention device 3 is displacably arranged in combustion chamber 5. Following the detachment of base block 16 from body 1, the entire assembly may thence be pulled out of the rear of body 1. The annular gap between flange 10 and combustion chamber 5 produces an air layer on the wall of said combustion chamber 5 downstream from flame retention device 3.

Combustion chamber 5 is secured to an outer tube 23 connected with body 1, its nozzle 6 being guided in the nozzle 24 of said outer tube, the upstream end of said combustion chamber 5 being supported on said outer tube 23 by elements 25 distributed around the upstream combustion chamber circumference and protruding therefrom.

The combustion chamber 5 and the outer tube 23 as well as the flame retention device 3 and the tip 20 of fuel lance 7 are made of ceramic material, making the burner fit for very high temperatures. The combustion chamber 3 may be secured to the outer tube by a slip joint, but in the embodiment of the present invention depicted in FIG. 1, a bolt 26 is used to secure the combustion chamber 5 to the outer tube 23 by an adhesive. Heat is applied to detach the combustion chamber 5 from the outer tube 23.

Figure 2:
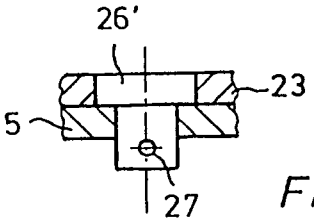
FIG. 2 is a representation of an alternative method of securing the combustion chamber and the outer tube of a burner in accordance with the present invention to each other.

Referring now to FIG. 2, the diagram shows a different embodiment of the join between the combustion chamber 5 and the outer tube 23. A set bolt 26' secures said combustion chamber 5 to said outer tube 23, the head of said bolt engaging in an opening in the outer tube 23 and the check of said bolt penetrating through the combustion chamber and being secured by a pin 27.

Figure 3:
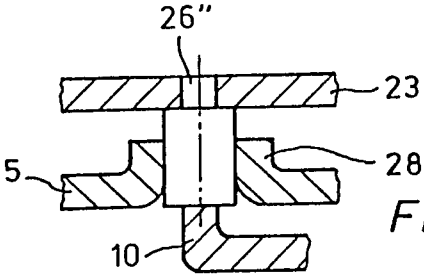
FIG. 3 is a representation of a further alternative method of securing the combustion chamber and the outer tube of a burner in accordance with the present invention to each other.

In the embodiment of the present invention depicted in FIG. 3, a set bolt 26" is again used to secure the combustion chamber 5 to the outer tube 23, but the shank engages in an opening in said outer tube 23 while the head engages in an opening in combustion chamber 25 at the point of the flange 10 of flame retention device 3.

Figure 4:
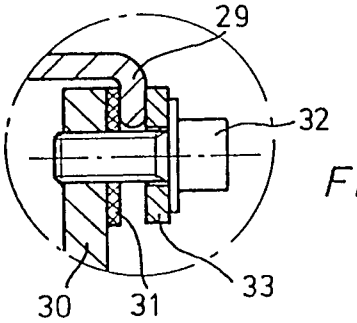
FIG. 4 is a view of detail A from FIG. 1.

FIG. 4 depicts the joint between the outer tube 23 and body 1. Said outer tube 23 is provided with a bent-edge 29 secured against a ring 30, at least one elastic ring-shaped washer 31 being provided between said edge 29 and said ring 30. The joint is tensioned by bolt 32 acting on a ring-shaped washer 33. Said ring 30 may be fastened to body 1 by screws 35 with a seal 34 being provided for sealing (see FIG. 1) without said ring attachment to said body 1 having any effect on the fastening of outer tube 23 by means of bolt 32.

Figure 5:
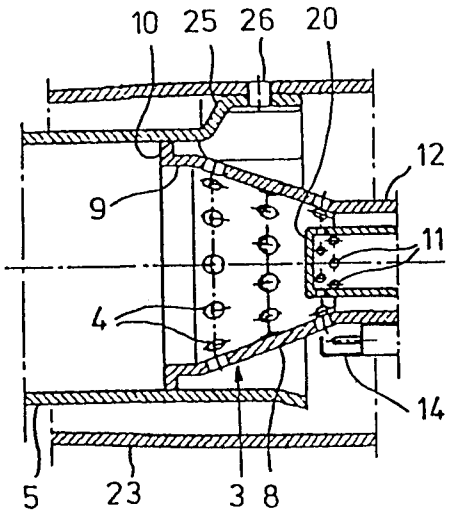
FIG. 5 is a section or part of a different embodiment of the present invention presented using the same view as in FIG. 1.

Since the radial exit openings 11 in burner lance 7 are in communication with the space inside cylindrical section 12 as shown by FIG. 1, the vibration level of the embodiment of the present invention depicted in FIG. 1 is relatively low. The embodiment of the present invention shown in FIG. 5, on the other hand, optimizes gas/air mixing in flame retention device 3. In said embodiment, the exit openings 11 in fuel lance 7 are arranged in the area of the first line of orifices 4 in jacket 8 allowing gas and air jets to mingle directly in particular in a preferred embodiment in which the exit openings 11 and the orifices 4 are arranged opposite each other. However, the vibration behavior of the embodiment of the present invention shown in FIG. 5 may not be as advantageous as the vibration behaviour of the embodiment of the present invention shown in FIG. 1.

Figure 6:
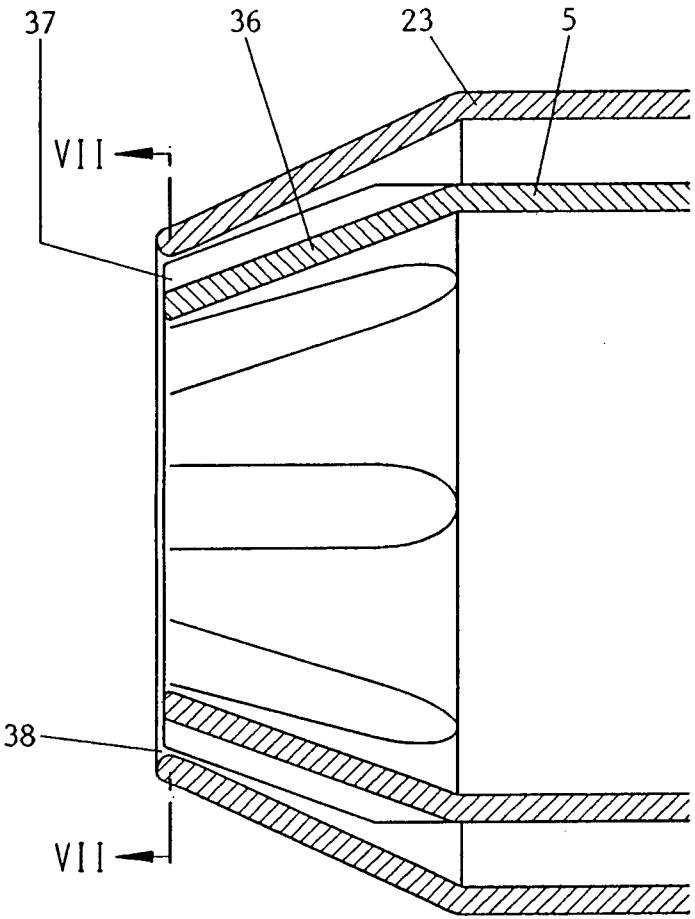
FIG. 6 is an axial section of part of another embodiment of the present invention along line V—-VI in FIG. 7.

Referring now to FIG. 6, the diagram is a schematic of the downstream part of the high-velocity burner proposed by the present invention showing the combustion chamber 5 with a downstream end 36 in the form of a nozzle and an outer tube 23 surrounding combustion chamber 5. Said outer tube 23 takes oxygen-carrier gas to said nozzle. The downstream end 36 of combustion chamber 5 is slightly receded relative to the downstream end of said outer tube 23, any mechanical damage thereby being limited to said outer tube 23. Such arrangement facilitates the visual identification of such a damage since it would be substantially more difficult to visually identify any damage to the combustion chamber 5.

Figure 7:
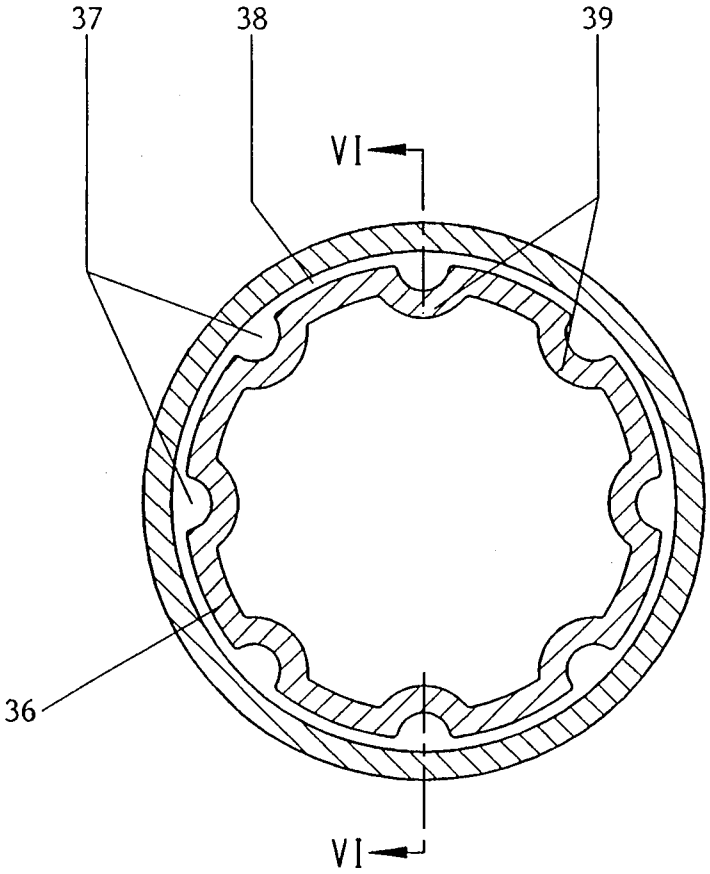
FIG. 7 is a section along line VII—VII in FIG. 6.

As shown by FIG. 7, the downstream end 36 of combustion chamber 5 and the downstream end of outer tube 23 enclose secondary oxygen-carrier gas exit openings 37 spaced relative to each other in the circumferential direction and gaps 38 which are passages between adjacent orifices 37. In the embodiment of the present invention shown in FIG. 7, said orifices 37 are obtained by concave cavities 39 in the downstream end 36 of combustion chamber 5.

The converging arrangement of orifices 37, the dimensions of orifices 37 and the dimensions of gap 38 are selected to obtain the desired mixing of oxygen-carrier gas with the flame exiting from the nozzle in order to limit the length of the flame and the formation of oxides of nitrogen.

Figure 9:
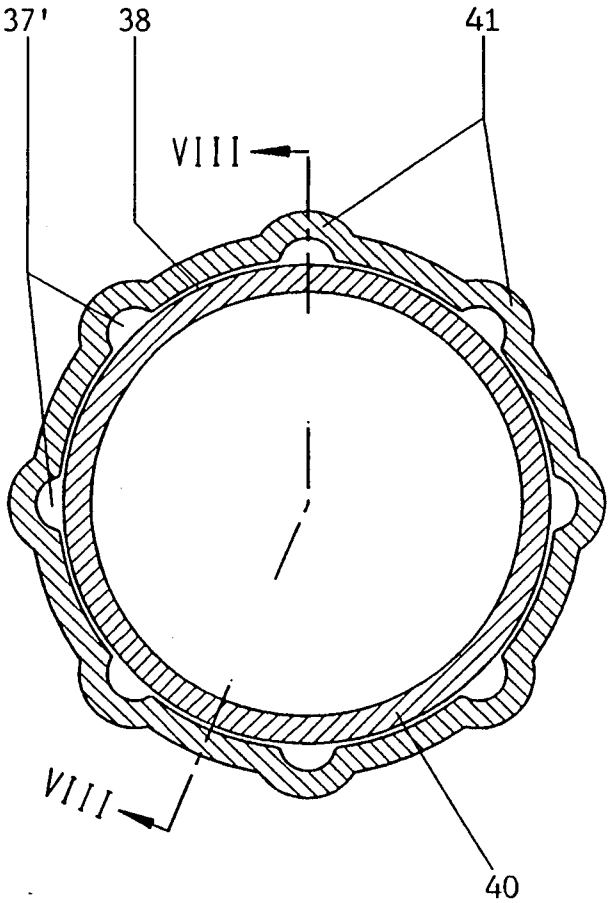
FIG. 9 is a section along line IX—IX in FIG. 8.
Figure 8:
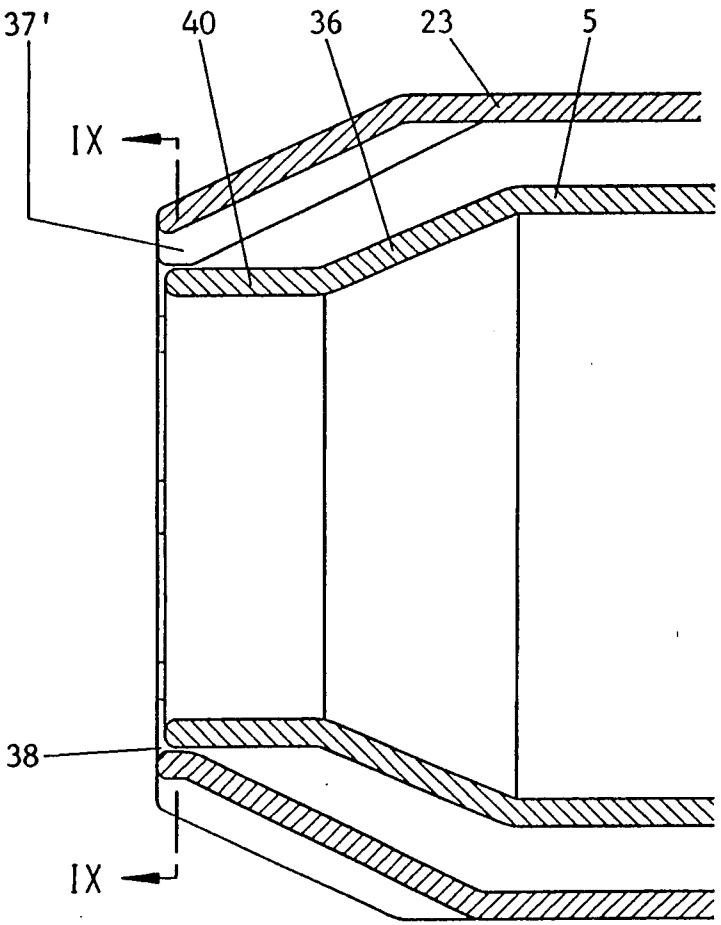
FIG. 8 is an axial section of part of a further embodiment of the present invention along line VIII—VIII in FIG. 9.

In the embodiment of the present invention depicted in FIGS. 6 and 7, the downstream end 36 of combustion chamber 5 and the downstream end of outer tube 23 are convergent relative to each other whereas the end 14 of combustion chamber 5 in the embodiment of the present invention depicted in FIGS. 8 and 9 is parallel to the direction of fluid flow through said combustion chamber, the downstream end of outer tube 23 approaching the nozzle discharge opening. The end axis of said outer tube is parallel to the direction of fluid flow through combustion chamber 5. Such an embodiment also causes converging oxygen-carrier gas jets to issue from the outer tube 23. The embodiment also allows an axial displacement of combustion chamber 5 relative to outer tube 23 to accommodate thermal expansion.

As FIG. 9 shows, the oxygen-carrier gas exit openings 37' are obtained by convex cavities 41 in outer tube 23 in the case of the embodiment of the present invention shown by FIGS. 8 and 9 causing the secondary oxygen-carrier gas jets not to mate with corresponding grooves in the flame as in the case presented in FIGS. 6 and 7 but to adjoin the outer periphery of the flame.

Figure 11:
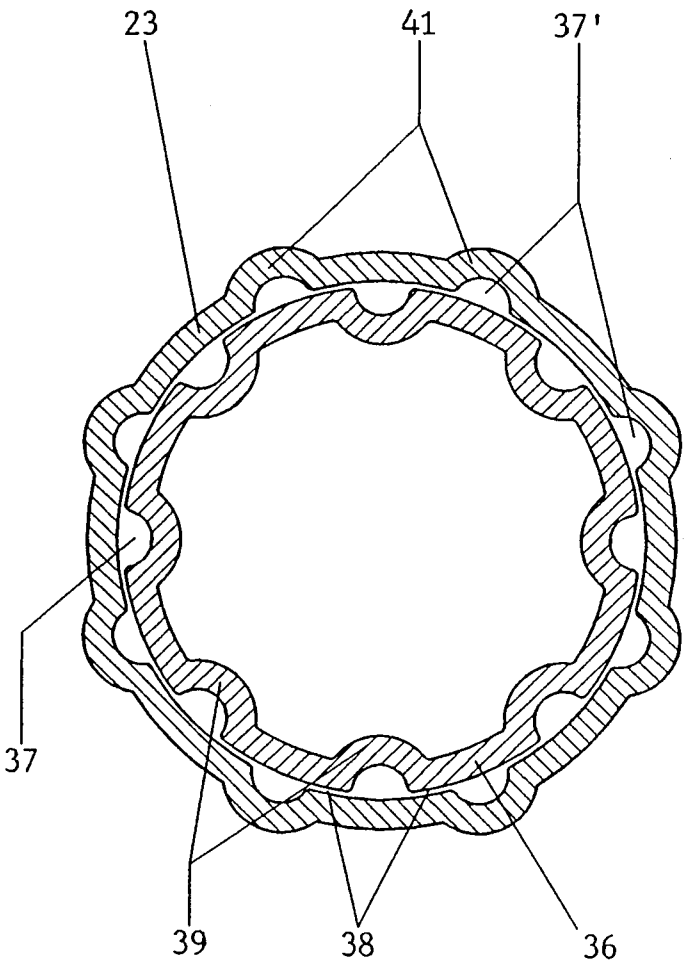
FIG. 11 is a view of the embodiment of the present invention depicted in FIG. 10, the outer tube and the combustion chamber having been rotated relative to each other.
Figure 10:
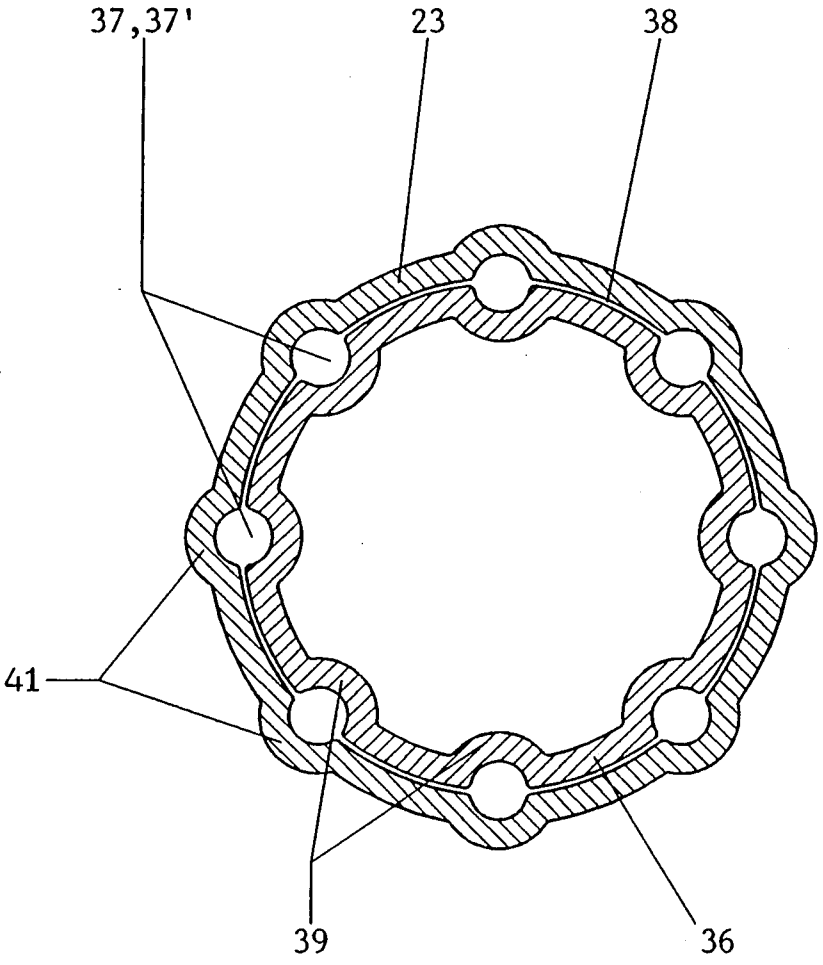
FIG. 10 is a section corresponding to that in FIG. 9 of a further embodiment of the present invention.

In the embodiment of the present invention shown by FIGS. 10 and 11, the downstream end 36 of combustion chamber 5 is provided with concave cavities 39 to form exit openings 37 while the outer tube 23 is provided with convex cavities 41 to form exit openings 36', both the nozzle and the outer tube 23 having symmetric cross-sections. The outer tube 23 and the nozzle are rotatable relative to each other.

In the position depicted in FIG. 2, exit openings 37 and 37' mate producing correspondigly thick oxygen carrier gas jets which are half embedded in the flame exiting from the nozzle.

In the position depicted in FIG. 11, if compared with the position depicted in FIG. 10, the outer tube 23 and the combustion chamber 5 have been rotated relative to each other by half the length of the gap between two adjacent orifices in FIG. 10. Oxygen-carrier gas jets exiting from orifices 37 will thus be embedded in the flame while oxygen-carrier gas jets exiting from orifices 37' adjoin the outer flame periphery, the pattern being annulated in the circumferential direction. A multiplicity of intermediate positions may be obtained between the two positions depicted in FIGS. 10 and 11.

FIGS. 7, 9, 10 and 11 show that the present invention thence provides for a multiplicity of combinations allowing the control of secondary oxygen-carrier gas and flame mixing. As the present invention also provides for flue gas recirculation, a wide range of flame, oxygen-carrier gas and flue gas layering may be achieved.

The oxygen carrier gas exiting from gaps 38 may also be used for flame control or, more specifically, flame cooling. However, the width of said gaps 38 will usually be small relative to the diameter of exit openings 37 and 37' because flow through said gaps 38 is difficult to control.

Figure 13:
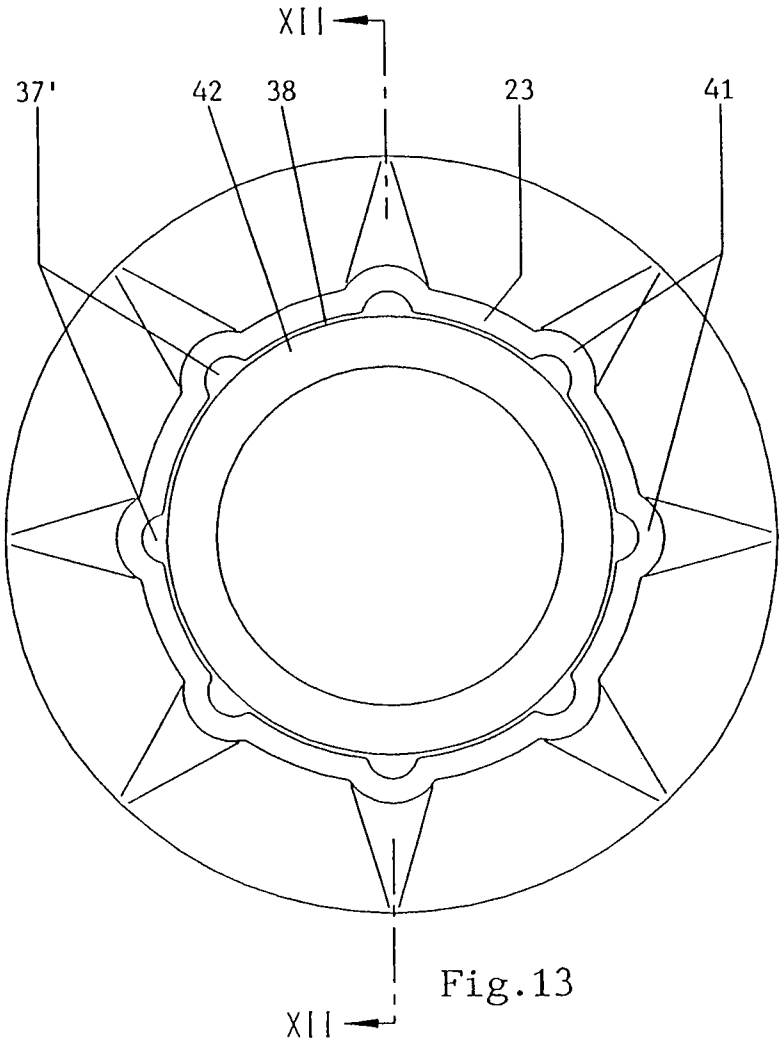
FIG. 13 is a frontal view of the embodiment of the present invention depicted in FIG. 12.
Figure 12:
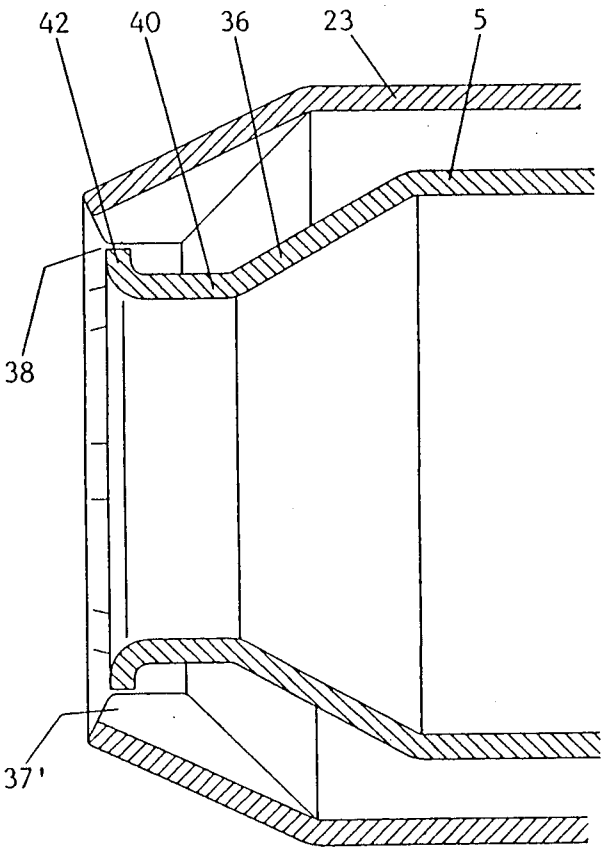
FIG. 12 is an axial section of part of a further embodiment of the present invention along line XII—XVII in FIG. 13.

The embodiment of the present invention depicted in FIGS. 12 and 13 is chiefly distinguished from the embodiment of the present invention shown by FIGS. 8 and 9 by a radial flange provided at the nozzle-type downstream end 36 of combustion chamber 5 having downstream parallel walls 40 in the embodiment depicted in FIG. 12, the outer tube 23 approaching said flange 42. Said flange 42 causes the oxygen carrier gas jets to be radially spaced relative to the foot of the flame at the points where they issue from the secondary oxygen-carrier gas exit openings thereby facilitating the induction of flue gas between the flame and the oxygen-carrier gas jets to optimize flame length and the formation of nitrogen oxides and to allow an adjustment of combustion staging.

In FIG. 12, the outer tube 23 protrudes slightly beyond the downstream end of flange 42 forming part of the combustion chamber nozzle, said funnel-type arrangement allowing an optimized control of the oxygen-carrier gas jets.

In the embodiment of the present invention depicted in FIGS. 12 and 13, the convex cavities 41 (unlike the cavities depicted in FIG. 8) increasingly protrude from outer tube 23 as width increases.

In the embodiment of the present invention shown in FIGS. 12 and 13, the combustion chamber 5 including its downstream end 36 and parallel walls 40 and the flange 42 are manufactured from monolythic ceramic material. The outer tube 23 is also manufactured from a monolythic ceramic substance. The combustion chamber 5 and the outer tube 23 may be arranged to allow axial displacement in the nozzle area as mentioned hereinbefore, in order to accommodate differences in thermal expansion and manufacturing tolerances. The wall thicknesses of the combustion chamber 5 and the outer tube 23 are the same in the embodiment of the present invention shown by FIGS. 12 and 13.

Figure 15:
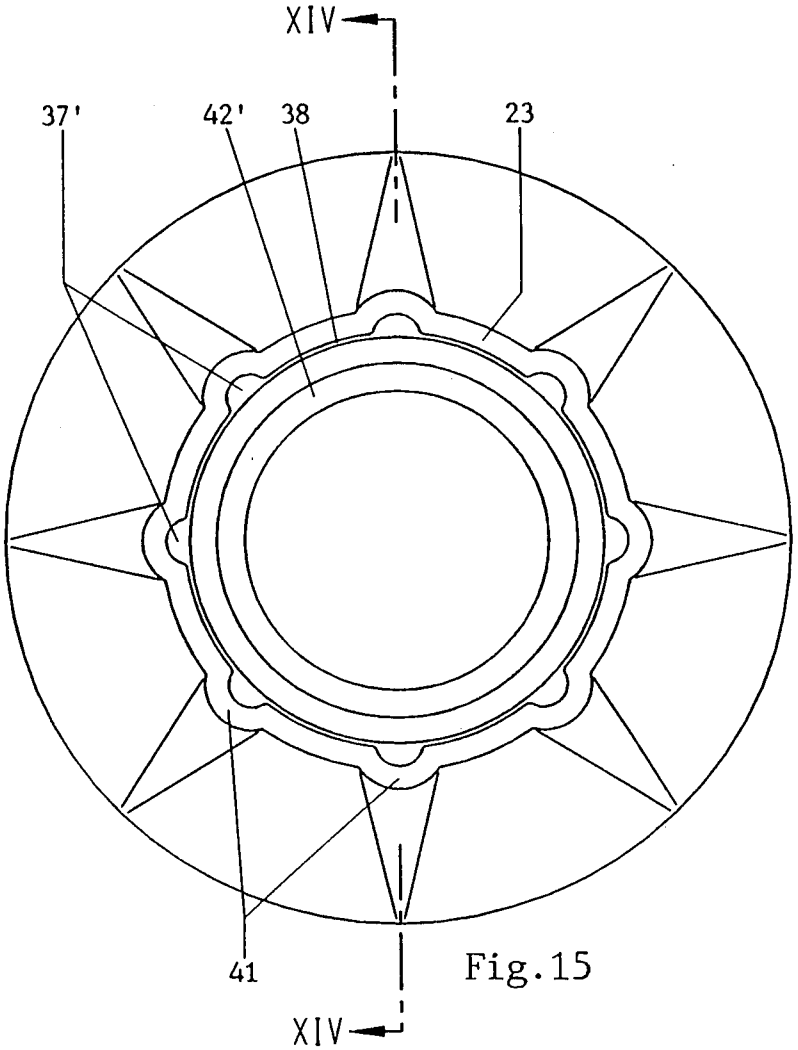
FIG. 15 is a frontal view of the embodiment of the present invention depicted in FIG. 14.
Figure 14:
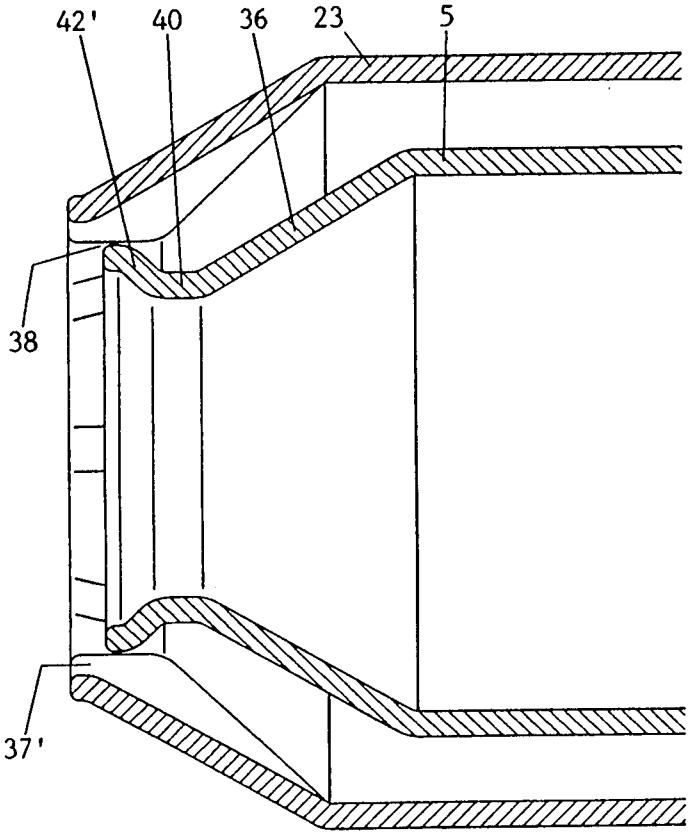
FIG. 14 is an axial section of part of a further embodiment of the present invention along line XIV—XIV in FIG. 15.

FIGS. 14 and 15 show parts of a high-velocity burner in accordance with the preachings of the present invention substantially designed like a burner depicted in FIGS. 12 and 13. However, unlike the burner in FIGS. 12 and 13, the burner in FIG. 14 is provided with an outer tube 23 with a downstream end parallel to the burner axis and the downstream end 36 of combustion chamber 5 downstream from section 40 is a flare 42' rather than a flange 42, said flare 42' having an outlet with walls parallel to the burner axis. An embodiment of the present invention in accordance with the teachings of FIGS. 14 and 15 facilitates fabrication from ceramic material.

Figure 17:
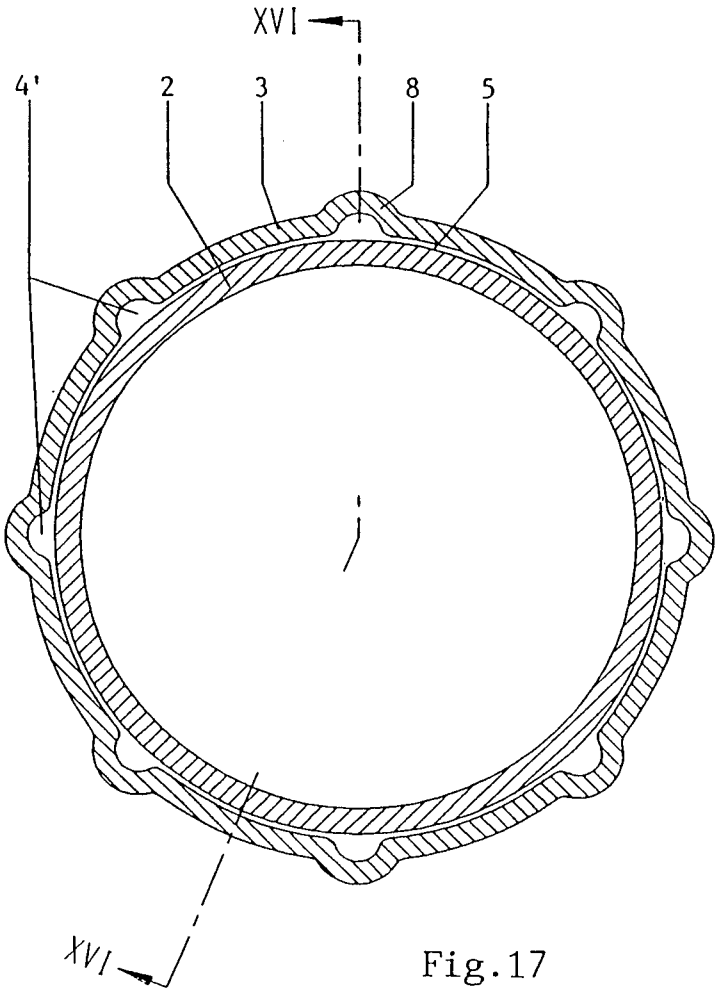
FIG. 17 is a section along line XVII—XVII in FIG. 16.
Figure 16:
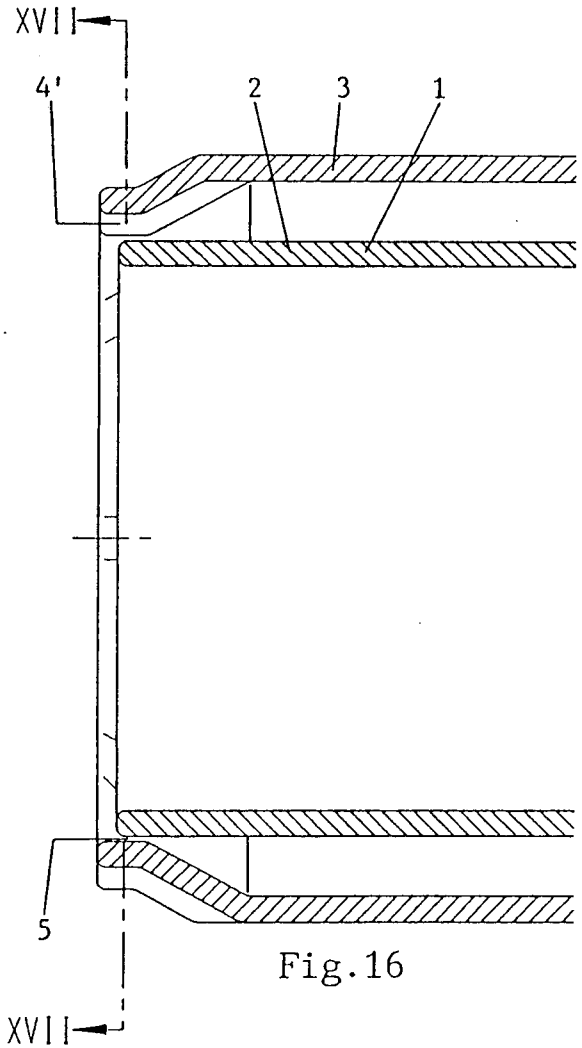
FIG. 16 is a section of part of a further embodiment of the present invention along line XVI—XVI in FIG. 17.

FIGS. 16 and 17 finally show the application of the present invention to the design of a burner which is not a high-velocity burner and the diameter of the combustion chamber 5 remains unchanged from its inlet to its downstream end 2.

The present invention allows a multiplicity of further variations. The join between the burner lance 7 and the cylindrical section 12 of the flame retention device 3 and the stub 17 may, for instance, be adjoined other than by a screw or clamp-on join. The application of the present invention is not limited to a burner with two combustion stages with secondary air being added at point 6 where the combustion chamber 5 is narrowest either, but the invention may readily be applied to single-stage burners designed for all combustion air to flow through flame retention device 3. Orifices 4 may further be at an angle relative to the flame retention device surface to produce swirl. The burner divulged by the present invention is fit for the combustion of any fluid or solid pulverized fuel.

The embodiments of the present invention depicted in FIGS. 8 and 9 and FIGS. 16 and 17 also feature a flange 40 as shown in FIGS. 12 and 13. The concave cavities 39 in the combustion chamber 5 depicted in FIGS. 6 and 7 may in addition be replaced by convex cavities 41 in outer tube 23. The embodiment of the present invention shown by said FIGS. 6 and 7 may also be provided with a flange 40 as shown in FIGS. 12 and 13. In the latter Figures and in FIGS. 8 and 9, the convex cavities 41 in the outer tube 23 may be replaced by concave cavities 39 in combustion chamber 5 or gaps 40 or flange 42 and in lieu of concave cavities, flange 42 may be provided with flange edge cutouts.

What is claimed:

1. A burner comprising:

a body containing an oxygen-carrier gas duct;

an outer tube having an open upstream end and an open downstream end, said upstream end mounted on said body so that said outer tube is a continuation of said oxygen-carrier gas duct;

a combustion chamber having an open upstream end and an open downstream end, said combustion chamber inserted in said outer tube so that said combustion chamber downstream end is substantially in alignment with said outer tube downstream end and said combustion chamber and outer tube downstream ends enclose exit openings spaced relative to each other in the circumferential direction allowing the exit of a secondary part of said oxygen-carrier gas through said openings in the form of jets with the jets substantially reaching the outer part of a flame discharged from said combustion chamber wherein said exit openings are formed by concave cavities in the downstream end of said combustion chamber and convex cavities in the downstream end of said outer tube; and a flame retention device inserted in the upstream part of said combustion chamber and having a substantially conical jacket diverging from a central inlet towards said combustion chamber, said jacket having orifices for the passage of a primary part of said oxygen-carrier gas; and means to take a fuel to the inlet of said flame retention device.

2. A burner according to claim 1 wherein a substantially cylindrical section is integrated in the downstream flame retention device end, said substantially cylindrical section becoming a substantially radial flange at the inlet of said combustion chamber.

3. A burner according to claim 1 wherein said means to take fuel to said flame retention device is a fuel lance with substantially radial exit openings, said exit openings being in communication with the space inside said flame retention device.

4. A burner according to claim 3 wherein said flame retention device is provided with an ignition opening in the area of said exit openings in said fuel lance and an ignition device is arranged inside said oxygen-carrier gas duct outside said ignition opening.

5. A burner according to claim 1 wherein said flame retention device is displacably arranged inside said combustion chamber.

6. A burner according to claim 5 wherein the downstream end of said combustion chamber is displacably arranged inside the downstream end of said outer tube and elements protruding from said combustion chamber in the upstream end thereof support said combustion chamber on said outer tube.

7. A burner according to claim 1 wherein said flame retention device, said combustion chamber and said outer tube are all made of ceramic material.

8. A burner according to claim 8 wherein the downstream ends of said combustion chamber and said outer tube are of symmetric substantially circular cross-sections and said combustion chamber and said outer tube are rotatable relative to each other.

9. A high-velocity burner comprising:

a body containing an oxygen-carrier gas duct;

an outer tube having an open upstream end and an open downstream end, said upstream end mounted on said body so that said outer tube is a continuation of said oxygen-carrier gas duct;

a combustion chamber having an open upstream end and an open reduced cross-sectional area downstream end, said combustion chamber inserted in said outer tube so that said combustion chamber downstream end is substantially in alignment with said outer tube downstream end and said combustion chamber and outer tube downstream ends enclose exit openings allowing the exit of a secondary part of said oxygen-carrier gas;

a flame retention device inserted in the upstream part of said combustion chamber and having a substantially conical jacket diverging from a central inlet towards said combustion chamber, said jacket having orifices for the passage of a primary part of said oxygen-carrier gas, said orifices being arranged in lines around the circumference of said jacket with orifices on adjacent lines being displaced relative to each other and the center lines through said orifices being at right angles relative t the tangents to said jacket in the direction of fluid flow through said burner and enclose an angle of between 90° and 45° with the tangents to said jacket in the direction of the circumference of said jacket; and means to take a fuel to the inlet of said flame retention device; wherein a slip joint is provided between said combustion chamber and said outer tube 4.

10. A high-velocity burner according to claim 9 wherein a substantially cylindrical section is integrated in the downstream end of said flame retention device jacket, said substantially cylindrical section becoming a substantially radial flange at the inlet of said combustion chamber.

11. A high-velocity burner according to claim 9 wherein said means to take fuel to said flame retention device is a fuel lance with substantially radial exit openings being in communication with the space inside said flame retention device.

12. A high-velocity burner according to claim 11 wherein said flame retention device is provided with an ignition opening in the area of said exit openings in said fuel lance and an ignition device is arranged inside said oxygen-carrier gas duct outside said ignition opening.

13. A high-velocity burner according to claim 11 wherein the inlet part of said flame retention device is substantially cylindrical and surrounds the exit openings in said fuel lance.

14. A high-velocity burner according to claim 13 wherein said fuel lance is connected with a stub protruding from a frontal base block of said burner body and said cylindrical inlet section of said flame retention device is placed on said stub and secured thereto to provide security against tensile forces.

15. A high-velocity burner according to claim 13 wherein said cylindrical inlet section of said flame retention device is provided with a purge opening.

16. A high-velocity burner according to claim 13 wherein said fuel lance carries a tip provided with exit openings and secured by a bolt passing therethrough and supported on said cylindrical inlet section of said flame retention device.

17. A high-velocity burner according to claim 9 wherein said flame retention device is displacably arranged inside said combustion chamber.

18. A high-velocity burner according to claim 17 wherein the downstream end of said combustion chamber is displacably arranged inside the downstream end of said outer tube and elements protruding from said combustion chamber in the upstream end thereof support said combustion chamber on said outer tube.

19. A high-velocity burner according to claim 9 wherein said flame retention device, said combustion chamber and said outer tube are all made of ceramic material.

20. A high-velocity burner according to claim 19 wherein said outer tube is held on a ring mounted on said burner body, the joint being tensioned, but elastic.

21. A burner comprising:

a body containing an oxygen-carrier gas duct; an outer tube having an open upstream end and an open downstream end, said upstream end mounted on said body so that said outer tube is a continuation of said oxygen-carrier gas duct;

a combustion chamber having an open upstream end and an open downstream end, said combustion chamber inserted in said outer tube so that said combustion chamber downstream end is substantially in alignment with said outer tube downstream end and said combustion chamber and outer tube downstream ends enclose exit openings spaced relative to each other in the circumferential direction allowing the exit of a secondary part of said oxygen-carrier gas through said openings in the form of jets with the jets substantially reaching the outer part of a flame discharged from said combustion chamber, wherein said exit openings are formed by convex cavities in the downstream end of said outer tube; and a flame retention device inserted in the upstream part of said combustion chamber and having a central fuel inlet and orifices for the passage of a primary part of said oxygen-carrier gas; and means to take fuel to said central flame retention device inlet.

22. A burner according to claim 21 wherein said exit openings allowing the exit of said secondary part of said oxygen-carrier gas through said openings are formed by concave cavities in the downstream end of said combustion chamber.

23. A burner according to claim 22 wherein the downstream ends of said combustion chamber and said outer tube are of symmetric substantially circular cross-sections and said combustion chamber and said outer tube are rotatable relative to each other.

24. A burner according to claim 21 wherein the cross-sectional area of the downstream end of said combustion chamber is smaller than the cross-sectional area of the upstream end of said combustion chamber.

25. A burner according to claim 21 wherein the arrangement of said exit openings allowing the exit of a secondary part of said oxygen-carrier gas is convergent.

26. A burner according to claim 21 wherein the downstream end of said combustion chamber is provided with a radial flange having an outer rim which is approached by said outer tube.

27. A burner according to claim 21 wherein the downstream end of said outer tube protrudes somewhat beyond the downstream end of said combustion chamber in a funnel-like configuration.

28. A burner according to claim 21 wherein the downstream end of said combustion chamber and the downstream end of said outer tube are displacable relative to each other in the axial direction.

29. A burner according to claim 21 wherein said combustion chamber and said outer tube are made from ceramic material of the same thickness.

* * * * *

UNITED STATES PATENT AND TRADEMARK OFFICE

CERTIFICATE OF CORRECTION

PATENT NO. : 5,055,032

DATED : October 8, 1991

INVENTOR(S) : Altemark et al.

It is certified that error appears in the above-identified patent and that said Letters Patent is hereby corrected as shown below:

In Claim 9 in column 11 at line 6 change "outer tube 4." to -- outer tube.--

Signed and Sealed this

Second Day of January, 1996

Bruce Lehman

*Attest:*

BRUCE LEHMAN

*Attesting Officer*

*Commissioner of Patents and Trademarks*